United States Patent [19]

Miyayama et al.

[11] 3,956,910

[45] May 18, 1976

[54] GUIDE ASSEMBLY FOR AN APPARATUS FOR FLUID TREATMENT OF FABRICS IN ROPE FORM

[75] Inventors: Shigeru Miyayama, Tokyo, Japan; Jiro Kawaskai, deceased, late of Tokyo, Japan, by Fumiko Kawasaki, legal representative

[73] Assignee: United Merchants and Manufacturers, Inc., New York, N.Y.

[22] Filed: Jan. 22, 1975

[21] Appl. No.: 542,940

[52] U.S. Cl. ..... 68/176
[51] Int. Cl.[2] ..... D06B 3/24
[58] Field of Search ..... 68/176, 212

[56] References Cited

UNITED STATES PATENTS

| | | | |
|---|---|---|---|
| 576,620 | 2/1897 | Rowe | 68/176 X |
| 2,580,892 | 1/1952 | Dameron | 68/176 |
| 3,604,224 | 9/1971 | Beasley | 68/176 |

FOREIGN PATENTS OR APPLICATIONS

| | | | |
|---|---|---|---|
| 113,153 | 1/1926 | Sweden | 68/176 |
| 581,649 | 7/1933 | Germany | 68/176 |

*Primary Examiner*—Philip R. Coe
*Attorney, Agent, or Firm*—Michael A. Caputo; John P. McGann

[57] ABSTRACT

An improved guide assembly for an apparatus for the fluid treatment of fabrics in rope form is provided which comprises a pair of cooperating comb-shaped guide members and driving means of said guide members in timed relationship in longitudinal and transverse reciprocations.

1 Claim, 6 Drawing Figures

GUIDE ASSEMBLY FOR AN APPARATUS FOR FLUID TREATMENT OF FABRICS IN ROPE FORM

BACKGROUND OF THE INVENTION

This invention relates to a guide assembly for an apparatus for the fluid treatment of fabrics in rope form, especially suited for an apparatus so-called a wince or winch machine.

The treatment of fabrics in rope form by partial passage through a bath containing a bleaching or dyeing medium is well-known and many kinds of apparatus for performing such treatments have been described in, e.g., Ziegler et al U.S. Pat. No., 3,308,639 and British Patent No. 1,076,680.

Wince machines as described in the above patents were generally designed for treatment of fabric in rope form within a liquid bath by a continuous feed of fabric in a form of a plurality of convolutions through partial passage in said liquid.

The convolution must be shifted regularly in the longitudinal direction, in other words, in a direction parallel to an axis of the wince roller to assure a uniform treatment of the fabric with the liquid. This shift was performed by a rotating helical guide or a movable peg rack which is rotated transversely through the rotated fabric convolutions by a sprocket-belt conveyer means.

These type of guide members have the following disadvantages:

1. Irregular treatment of fabric due to the continuous engagement with the helical flights or extending fingers of the guide members.

2. Entangelement of adjacent convolutions of fabric so-called "jumping" due to open pockets defined by said adjacent helical flights or fingers.

3. Necessity of exchange of helical guide member having various pitches to alter the shift distance.

The disadvantage of the above (1) may result in an insufficient treatment of fabric, e.g., dyeing specks, and the above (2) will cause a destruction of the machine unless some safety measure is provided. The exchange of the helical guide members of the above (3) is a troublesome and time consuming operation.

SUMMARY OF THE INVENTION

The principal object of the present invention is to eliminate the above-mentioned disadvantages, and the guide assembly constructed in accordance with the invention includes a pair of guide members in a form of comb-like configuration and driving means operable in a timed relationship with the rotation of wince roller. Said guide members are to be horizontally reciprocated with timed relationships to each other in longitudinal and transversal directions so as to shift the convolution of fabric periodically and at a given distance, without causing the continuous engagement of the comb teeth or fingers and entanglement of the adjacent convolutions of fabric due to the formation of closed pockets with opposing pairs of fingers.

One of the embodiments of the present invention is shown in the attached drawings.

DESCRIPTION OF THE PREFERRED EMBODIMENT

Figure 1:
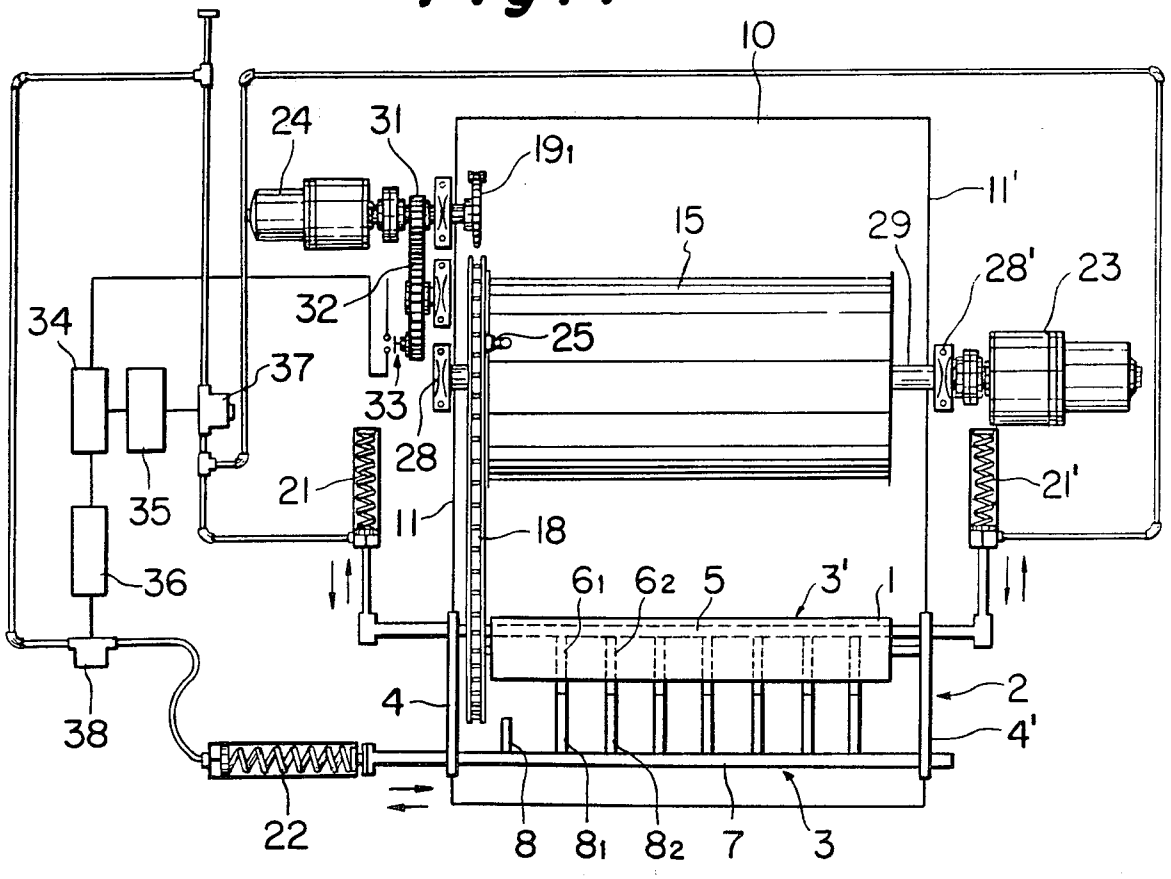
FIG. 1 is a plan view of a wince machine provided with a guide assembly constructed in accordance with the present invention.
Figure 2:
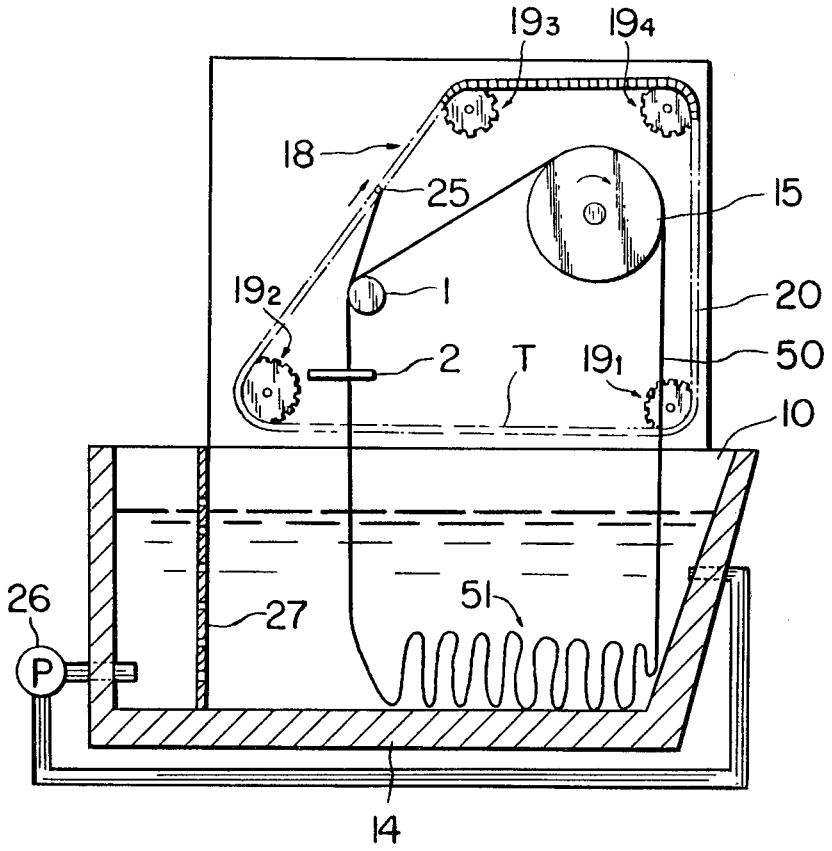
FIG. 2 is a side section of the machine shown in FIG. 1.
Figure 3:
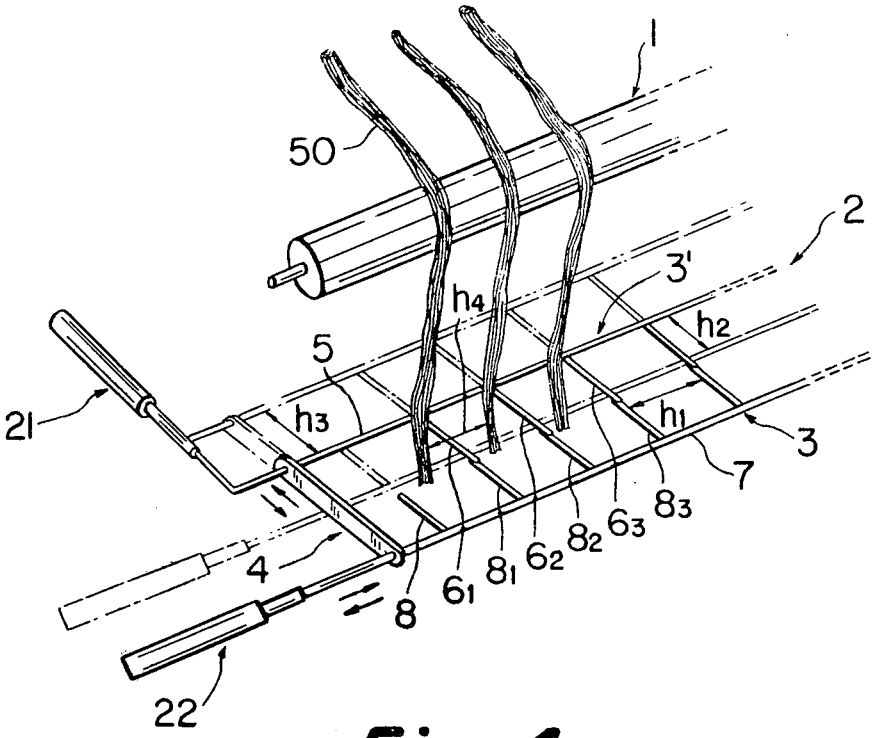
FIG. 3 is a perspective view of a portion of the assembly of the invention shown together with a part of the guide roll and a few convolutions of fabric.

Referring now to the drawings, a guide assembly constructed in accordance with the present invention is generally shown by the reference numeral 2 in FIGS. 1, 2 and 3. The assembly consists of a pair of guide members, specifically a front guide member 3 and a rear guide member 3' disposed beneath a guide roll 1 and above the liquid surface in a tank 10. Each guide member comprises a supporting bar 5 (or 7) extending through the side wall 11 (or 11') of the machine and a plurality of pins or fingers 6 (or 8) perpendicularly extending from said bar at an appropriate interval. Each guide member has equally spaced fingers and since the both members may be reciprocated transversely to the axis of the guide roll 1 by a suitable driving means, both members defining a plurality of closed pockets between the adjacent fingers.

Figure 4:
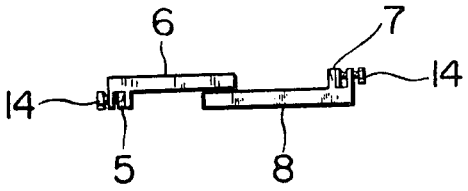
FIG. 4 is a side view of the opposing fingers of the guide members.

The front member 3 has an additional end finger as 8, and timely reciprocated in a longitudinal direction to the axis of the guide roll. The ends of these opposing pair of fingers preferably are overlapped as shown in FIG. 4 to form a definite pocket area between the both members.

Figure 5:
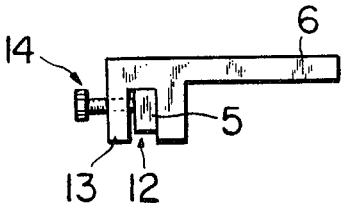
FIG. 5 shows an engagement of a finger with a supporting bar.

Now consider a situation wherein a plurality of convolutions of fabric running transversely over the wince roll 15 and the guide roll 1 are to be shifted periodically a predetermined distance in the right direction. The guide assembly 2 is disposed below and along the guide roll 1 as shown in FIG. 2, and supported by a pair of frames 4 and 4'. Each supporting bar 5 and 7 has the fingers $\mathbf{6}_1$, $\mathbf{6}_2$ . . . and 8, $\mathbf{8}_1$, $\mathbf{8}_2$ . . . of a length $h_2$ at an equal interval $h_1$. In one embodiment of the present invention the pins 6 are affixed to the bar as shown in FIG. 5. At the rear end of the finger there is provided a pair of lugs 13 integral therewith and extending downwardly forming a groove 12, and the bar 5 inserted into the groove 12 is fixed by a set screw 14. Therefore, the interval $h_1$ may be adjusted as desired.

Figure 6:
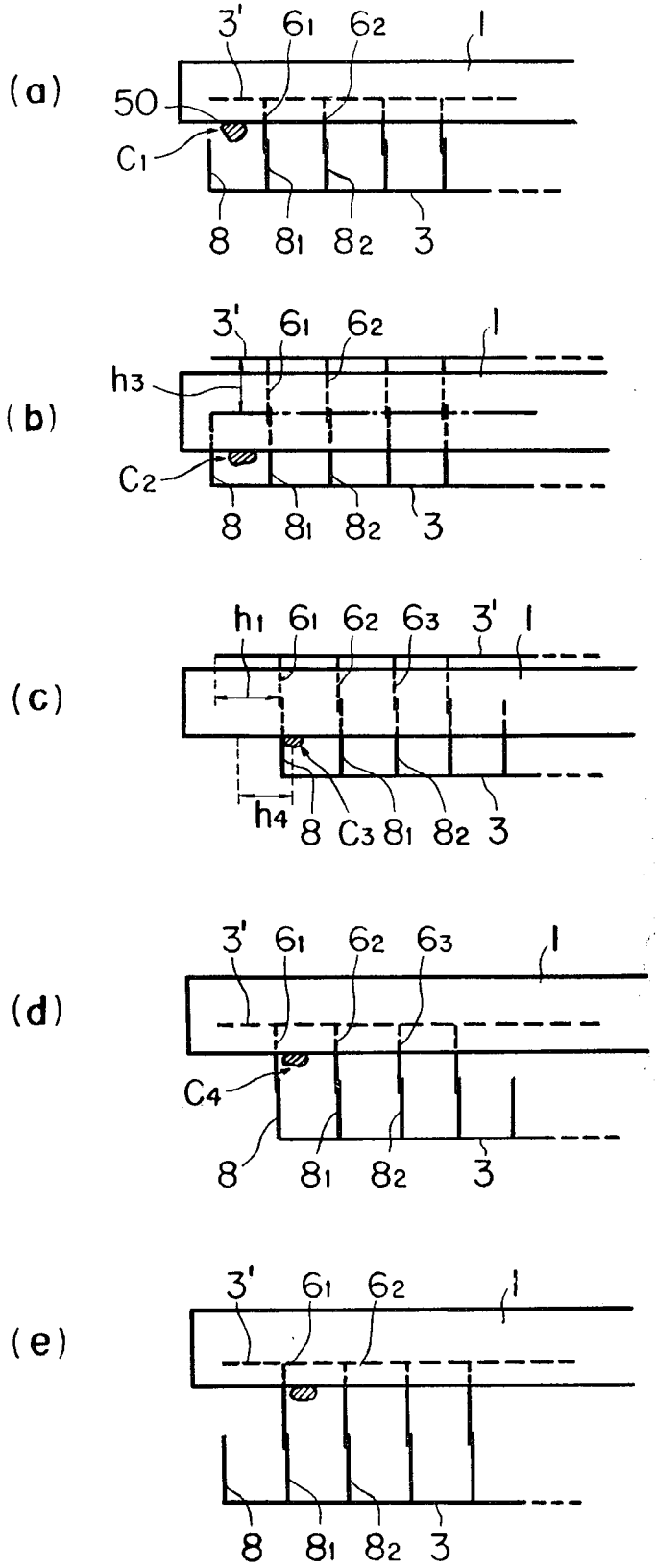
FIG. 6 is a diagramatic view showing a cycle of relative movements of the opposing guide members.

Now the shifting of convolution of fabric will be described with reference to FIG. 3 and FIG. 6 schematically illustrating one cycle of operation.

At first, it is assumed that the convolution of fabric 50 in rope form is driven upwardly through a position $C_1$ between the fingers 8 and $\mathbf{8}_1$. A pair of pressure cylinders 21, 21' (FIG. 1) provided on the both sides of the machine are operated in a timed relationship with the travelling of the convolution, causing a retraction of transverse movement of the assembly 2 consisting of both members 3 and 3' endwisely connected by a pair of connecting plates 4 and 4' by a distance $h_3$ as shown in FIG. 6(b). Then a pressure cylinder 22 provided in alignment with the supporting bar 7 of the front member 3 is operated after a predetermined time, causing a longitudinal movement of only the guide member 3 in the right direction by one interval of the adjacent fingers by a slidable connection of the supporting bar 7 through holes formed in the frames 4 and 4', as shown in FIG. 6(c).

Then these cylinders 21, 21' are operated in the reverse direction causing the forward and transverse movement of the whole assembly leaving the convolution at the same position of $C_3$ as shown in FIG. 6(d). The last sequence is performed by the reverse operation of the cylinder 22 causing the leftward movement of the front guide member 3 to the original position. Thus one cycle of operation is completed.

Successive sequence of the above-mentioned cycles will cause cycle shiftings of the convolutions of fabric in the right direction. It should be recognized that the longitudinal movement may be imparted to the rear guide member 3' instead of the front guide member 3.

A driving system for the timed movements of the guide assembly and the front guide member will be described later.

A wince machine incorporating the guide assembly constructed in accordance with the present invention in place of a helical guide member is shown in FIGS. 1 and 2, wherein the reference numeral 10 denotes a liquid bath, 11, 11' side walls of the tank, 15 a wince roll, 1 a guide roll, 2 a guide assembly in accordance with the present invention, and 18 is a driving chain. The wince roll is driven for rotation by means of an electric motor 23. The guide roll 1 is suitably supported for free rotation below the roll 15 and above the liquid surface in parallel to said roll 15. The guide assembly 2 is disposed forwardly below said guide roll.

The chain 18 driven from another electric motor 24 along a predetermined vertical path 20 around sprockets 19 shown in FIG. 2 has a hook 27 to which a leading end of the fabric is connected with a length of a connection cloth. This path determines the length of convolution of fabric which forms a plurality of pleats 51 in the bottom of the bath. The treating liquid is circulated by a pump means 26 through a deflector means 27.

In operation, with actuation of motors 23 and 24, the roll 15 is rotated in the direction of an arrow and the chain is driven in the same direction along the path 20. Gearing ratio of gears 31 and 32 is selected that one round of the chain 18 driven by the sprocket 19 along the path 20 corresponds to one revolution of the gear 32. Therefore, when a relay switch 33 attached to the gear 32 is closed which actuates the pair of pressure cylinders 21 and 21' through a delay switch 34, the control switch 35, and three-way electromagnetic valve 37, causing the retraction or backward movement of the guide assembly 2. A predetermined period of time, e.g., 2 seconds, after the completion of the above-mentioned backward movement of the guide assembly the delay switch 34 actuates the pressure cylinder 22 through the control valve 36 and the electro-magnetic valve 38, moving the front guide member 3 in the right direction thus shifts the convolution of fabric by one interval. Then the cylinders 21, and 21' are again actuated in the reverse direction after a predetermined period of, e.g., 6 seconds, and after an additional period of time, e.g., 6 seconds, the cylinder 22 is again actuated in the reverse direction restoring the whole guide assembly in the original position.

With the above-mentioned arrangement it will be appreciated that the successive passage of the chain 18 along the path 20 forms a series of convolutions of fabric, which convolution may be surely shifted at a predetermined interval, without causing the above-mentioned continuous engagement of the convolution with the helical guide and any entanglement of the adjacent convolutions.

From the above description, it should be understood also that the adjustment of the interval between the fingers of the guide member enables an increased field of application of the guide members for various kinds of the fabric to be treated and assures a regular shifting of the convolutions of fabric by the enclosed pockets always formed by the adjacent fingers in the guide assembly constructed in accordance with the present invention.

While the preferred form of the present invention has been set forth in the above description, such is to be considered as merely exemplary of the concept of the invention, many changes in construction and arrangement may be possible in accordance with the scope and spirit of the present invention.

We claim:

1. In a wince machine having a tank containing treating liquid, a wince roll on which a plurality of convolutions of fabric may be transversely engaged and a driving means for the wince roll and fabric, an improved guide assembly comprising a pair of comb-shaped guide members, each having a plurality of opposing fingers; means for timely reciprocating said assembly transversely with respect to the rotational axis of the wince roll; and means for longitudinally reciprocating at least one of said guide members with respect to said axis in timed relation with said transverse reciprocation of the assembly to regularly shift the convolutions of the fabric in one direction.

* * * * *